US011753912B2

(12) United States Patent
Fripp et al.

(10) Patent No.: US 11,753,912 B2
(45) Date of Patent: Sep. 12, 2023

(54) PHASE CHANGING GAS-LIFT VALVES FOR A WELLBORE

(71) Applicant: Halliburton Energy Services, Inc., Houston, TX (US)

(72) Inventors: Michael Linley Fripp, Singapore (SG); Paul James, Spring, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/491,023

(22) Filed: Sep. 30, 2021

(65) Prior Publication Data

US 2023/0098639 A1 Mar. 30, 2023

(51) Int. Cl.
*E21B 34/10* (2006.01)
*E21B 43/12* (2006.01)

(52) U.S. Cl.
CPC ..... *E21B 43/123* (2013.01); *E21B 34/10* (2013.01)

(58) Field of Classification Search
CPC ..... E21B 43/123; E21B 34/10
See application file for complete search history.

(56) References Cited

U.S. PATENT DOCUMENTS 3,583,481 A * 6/1971 Vernotzy ..... E21B 23/08 166/321
6,932,581 B2 * 8/2005 Messick ..... F04F 1/20 417/112
7,658,229 B2 * 2/2010 Becker ..... E21B 43/123 417/115
7,866,400 B2 1/2011 Steele et al.
8,096,362 B2 1/2012 Steele et al.
9,284,825 B2 * 3/2016 Yu ..... F16K 31/025
9,752,698 B2 * 9/2017 Mathiesen ..... E21B 43/12
9,879,509 B2 * 1/2018 De Almeida ..... E21B 43/123
10,018,024 B2 * 7/2018 Greci ..... E21B 43/122
10,119,362 B2 * 11/2018 Fripp ..... E21B 43/24
10,294,763 B2 * 5/2019 Kleppa ..... E21B 43/123
2009/0218089 A1 9/2009 Steele et al.
2011/0127043 A1 6/2011 Hahn et al.
2012/0145404 A1 6/2012 Schultz et al.
2017/0152733 A1 6/2017 Salihbegovic

FOREIGN PATENT DOCUMENTS

WO 2013034185 3/2013
WO 2021086496 A1 5/2021

OTHER PUBLICATIONS

PCT Application No. PCT/US2021/052973, "International Search Report and Written Opinion", dated Jun. 23, 2022, 10 pages.

* cited by examiner

*Primary Examiner* — Kenneth L Thompson
(74) *Attorney, Agent, or Firm* — Kilpatrick Townsend & Stockton LLP

(57) ABSTRACT

A gas-lift valve in a wellbore may include a valve housing and a flow restrictor. The valve housing may at least in part define a chamber for receiving an actuation fluid. The flow restrictor may have a position that is controllable by adjusting a downhole pressure to change a density of the actuation fluid in the chamber. The gas-lift valve may be positioned on production tubing in an annulus of a wellbore. Controlling the position of the flow restrictor may restrict an opening in the production tubing through which gas may flow.

20 Claims, 5 Drawing Sheets

PHASE CHANGING GAS-LIFT VALVES FOR A WELLBORE

TECHNICAL FIELD

The present disclosure relates generally to wellbore operations and, more particularly (although not necessarily exclusively), to a phase changing gas-lift valve for a wellbore.

BACKGROUND

A wellbore environment can include a wellbore drilled through a subterranean formation for extracting hydrocarbons from a reservoir. The wellbore environment may also include a gas lift system for controlling the flow of gas into production tubing in the wellbore. The gas lift system may include one or more gas-lift valves in a gas-lift mandrel that may be positioned in an annulus of the wellbore. In some examples, the extracted hydrocarbons may be too dense to flow up the production tubing to a surface of the wellbore. To lower the density of the hydrocarbons, gas or other fluids may be pumped into the production tubing via the gas-lift valves, allowing the hydrocarbons to flow upwards in the wellbore for extraction. The gas-lift valve may control the flow of gas into the production tubing as the gas flows through an opening.

DETAILED DESCRIPTION

Figure 1:
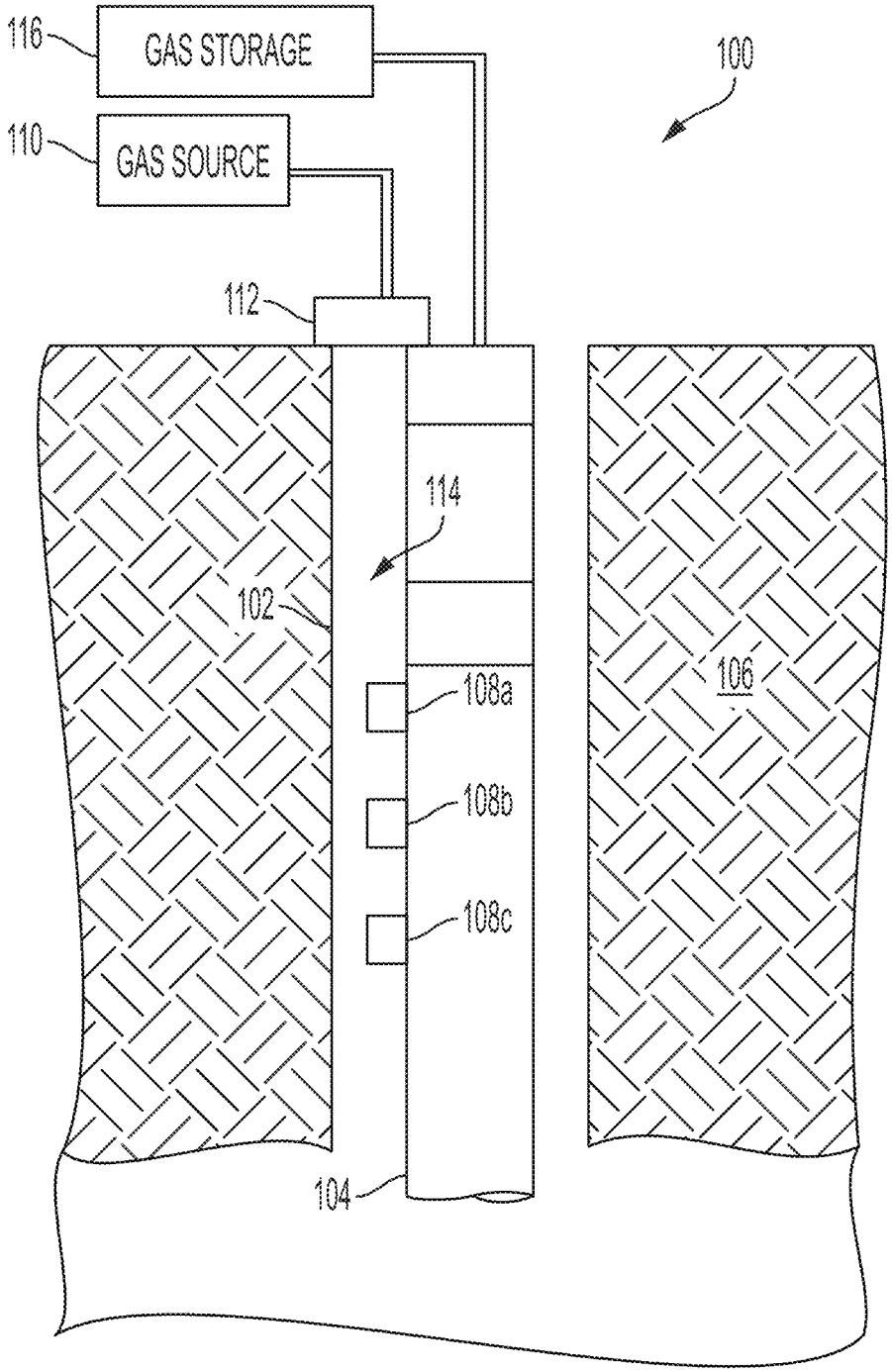
FIG. 1 is a schematic of a wellbore environment including gas-lift valves according to some aspects of the present disclosure.

Certain aspects and examples of the present disclosure relate to a gas-lift valve that is wirelessly adjustable for controlling a flow rate of gas or other fluids through the gas-lift valve for a wellbore. The flow of gas through the gas-lift valve may be controlled via changes in pressure of an annulus of the wellbore. The gas-lift valve may include a valve housing for an actuation fluid and may include a flow restrictor for adjusting a size of an opening through which gas may flow. In response to changes in pressure from the surface, the actuation fluid may experience changes in density that may cause the actuation fluid to compress or expand, and in some examples may experience a phase change. The changing density of the actuation fluid may cause the position of the flow restrictor to adjust, changing the size of the opening. In some examples, the gas-lift valve may operate in a critical flow regime. During critical flow, the velocity of the gas through the gas-lift valve may reach near-sonic speeds. As pressure waves cannot travel faster than sonic speed, the flow rate of the gas may be limited and may cause the flow rate to be independent of downstream conditions. Thus, the gas-lift valve may be adjustable from the surface of the wellbore. The gas-lift valve's remote adjustability may reduce the likelihood of improperly setting the size of the opening in the gas-lift valve.

In one example, the valve housing of the gas-lift valve may include a piston that may control the position of the flow restrictor. The piston may be driven by the actuation fluid experiencing a phase change due to a change in downhole pressure. As the downhole pressure changes, the piston may move the flow restrictor and change the size of the opening. Thus, the opening in the gas-lift valve may be adjustable from the surface without the use of electronics. Small changes to the downhole pressure may allow for fine control over the gas flow through the gas-lift valve.

In another example, the valve housing may be a bellow. As the actuation fluid contracts or expands, the bellow may contract or expand to push the flow restrictor to close or open the opening. At lower downhole pressures, the actuation fluid expands the bellow to move the flow restrictor towards the opening, reducing the size of the opening. At higher downhole pressures, the actuation fluid contracts the bellow to move the flow restrictor away from the opening, increasing the size of the opening.

In some examples, gas-lift valves may be installed deep in the wellbore to aid production. During well kickoff, gas-lift valves may be placed at various depths in the wellbore between the bottom and the surface of the wellbore. The kickoff gas-lift valves may only be necessary during the unloading of the well, and may be closed after unloading to increase efficiency of recovery.

In some examples, different phase valves installed at different depths in the wellbore may have different phase transition temperatures or pressures. For examples, a first gas-lift valve installed at the bottom of the wellbore may have a phase transition pressure of 300 psi, while a second gas-lift valve installed at the top of the wellbore may have a phase transition of 500 psi. During unloading, where downhole pressure is reduced to initiate flow of hydrocarbons in the wellbore, the downhole pressure of the annulus may be set to 500 psi. At this pressure, gas injected into the annulus of the wellbore may pass through both the first gas-lift valve and the second gas-lift valve into the production tubing. After unloading, the downhole pressure may be reduced to a pressure between 300 psi and 500 psi, causing the injected gas to flow through the first gas-lift valve at the bottom of the wellbore but not through the second gas-lift valve at the top of the wellbore.

In other examples, multiple gas-lift valves may be installed at the bottom of the wellbore. Each of the multiple gas-lift valves may have a different phase transition temperature or pressure via the use of different actuation fluids or different types of valves. This may create a wider range of sizes of openings for gas flow that may occur at different downhole temperatures or pressures.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellbore environment 100 including gas-lift valves 108*a-c* according to some aspects of the present disclosure. The wellbore environment 100 may include a wellbore 102, a production tubing 104 in the wellbore 102, and a wellhead 112 for sealing pressure in the wellbore 102. The wellbore 102 may extend through various earth strata 106. The gas-lift valves 108*a-c* may be positioned on the outside of the production tubing 104 and in an annulus 114 between the production tubing 104 and the wellbore 102. Alternatively, the gas-lift valves 108*a-c* may be positioned in-line with the production tubing 104. A gas source 110 at a surface of the wellbore environment 100 can control the flow of gas and downhole pressure in the annulus 114. The gas source 110 may include a compressor (not shown). Although three gas-lift valves 108*a-c* are depicted in FIG. 1, more or fewer gas-lift valves 108 may be included. Gas-lift valves 108 may be installed at any point along the production tubing 104. It should be noted that while wellbore 102 is shown as a vertical wellbore, wellbore 102 can additionally or alternatively have a substantially horizontal section.

During operation of the wellbore environment 100, the gas source 110 may inject gas downhole into the sealed annulus 114, creating downhole pressure. If the gas-lift valves 108*a-c* are open, the gas may flow through some or all of the gas-lift valves 108*a-c* into the production tubing 104. The gas may mix with produced wellbore fluid, causing the produced wellbore fluid to rise to the surface of the wellbore environment 100. The gas at the surface can be captured by the gas storage device 116 to be held for other uses or recycled. The gas storage device 116 may include a storage tank.

Figure 2:
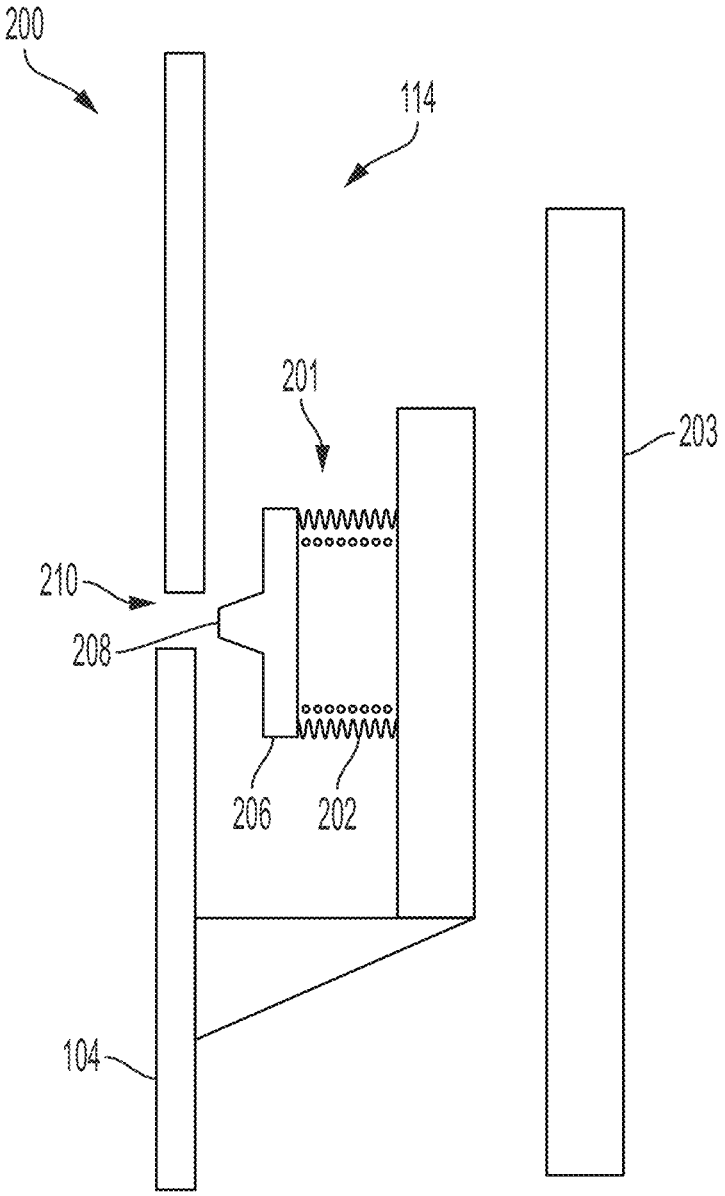
FIG. 2 is a side view of a gas-lift valve with a bellow in a section of the wellbore according to some aspects of the present disclosure.

FIG. 2 is a side view of a gas-lift valve 201 with a bellow 202 in a section of the wellbore 200 according to some aspects of the present disclosure. The wellbore 102 may include a casing string 203 lining the wellbore 102, with an annulus 114 between the production tubing 104 and the casing string 203. The gas-lift valve 201 may be positioned in the annulus 114 and on the production tubing 104. The bellow 202 may include a chamber for housing an actuation fluid, such as a gas. The gas-lift valve 201 may also include a flow restrictor 206 with a head 208. As downhole pressure in the annulus 114 changes, the actuation fluid in the bellow 202 may expand. The expanding actuation fluid may expand the bellow 202, pushing the flow restrictor 206 towards the production tubing 104. The head 208 of the flow restrictor 206 may restrict an opening 210 of the production tubing 104. The sloped sides of the head 208 may allow the size of the opening 210 to vary depending on the position of the flow restrictor. For example, full expansion of the bellow 202 may cause the head 208 to fully restrict the opening 210 to prevent gas from flowing into the production tubing 104. Other expansions of the bellow 202 may cause the head 208 to block some or none of the opening 210.

In some examples, the downhole pressure may be adjusted by injecting a second fluid, such as a gas via the gas source 110, into the annulus 114. In one example, the injected fluid may be a same or similar fluid as the actuation fluid, such as a combination of methane and ethane. Alternatively, the injected fluid may be a different fluid than the actuation fluid. For example, the injected fluid may have a lower density than the actuation fluid. Thus, small changes in the injection pressure in the annulus may result in significant volume changes as the actuation fluid undergoes a phase transition. The significant volume changes may create significant changes in the size of the opening 210, which may control the flow rate of the injected fluid into the production tubing 104.

For example, the injected fluid may be methane gas injected by the gas source 110 with an injection pressure resulting in a downhole pressure of 190 psi and a downhole temperature of 100° F. The actuation fluid may be propane. If the gas source 110 reduces the downhole pressure to 180 psi, the propane may expand as a gas, thus expanding the bellow 202 and reducing the size of the opening 210. If the gas source 110 increases the downhole pressure to 200 psi, the propane may experience a phase change by condensing into a liquid. The propane changing from a gas to a liquid may cause the bellow 202 to contract, which may result in a discretized change in the size of the opening 210.

In another example, the actuation fluid may be carbon dioxide. If the downhole pressure is 1250 psi and the downhole temperature is 100° F., the carbon dioxide may be in a supercritical state between a gas and a liquid. While the carbon dioxide is in a supercritical state, changing the downhole pressure may result in substantial volume changes. For example, the volume of the supercritical carbon dioxide may double in size as the downhole pressure decreases from 1350 psi to 1150 psi. This may enable a continuous variation in the size of the opening 210 with the pressure of the injected gas. Although the carbon dioxide does not experience a change in its state of matter (gas, liquid, solid, or supercritical) in these conditions, these density changes can be considered to be a phase change because the density of the carbon dioxide may change significantly over a narrow pressure range. Other gases that experience supercritical states may also be used as actuation fluids.

In some examples, the actuation fluid may be a combination of fluids. For example, the combination of fluids may be an azeotrope with a characteristic phase change. Alternatively, the combination of fluids may be a zoetrope with several phase changes, or with a phase change that occurs over a range of pressures.

In some examples, the bellow 202 may be biased with a spring to decrease or increase the pressure in the actuation fluid. For example, the bellow 202 may include an actuation fluid of propane along with a spring that may reduce the pressure of the propane by 200 psi. As a result, the propane may condense when the downhole pressure is 390 psi because the propane is experiencing a biasing pressure of 190 psi. This biasing pressure may be useful for adjusting the downhole pressure. In some examples, the spring and the bellow may be a single component. Alternatively, the spring may be external to the bellow.

Figure 3:
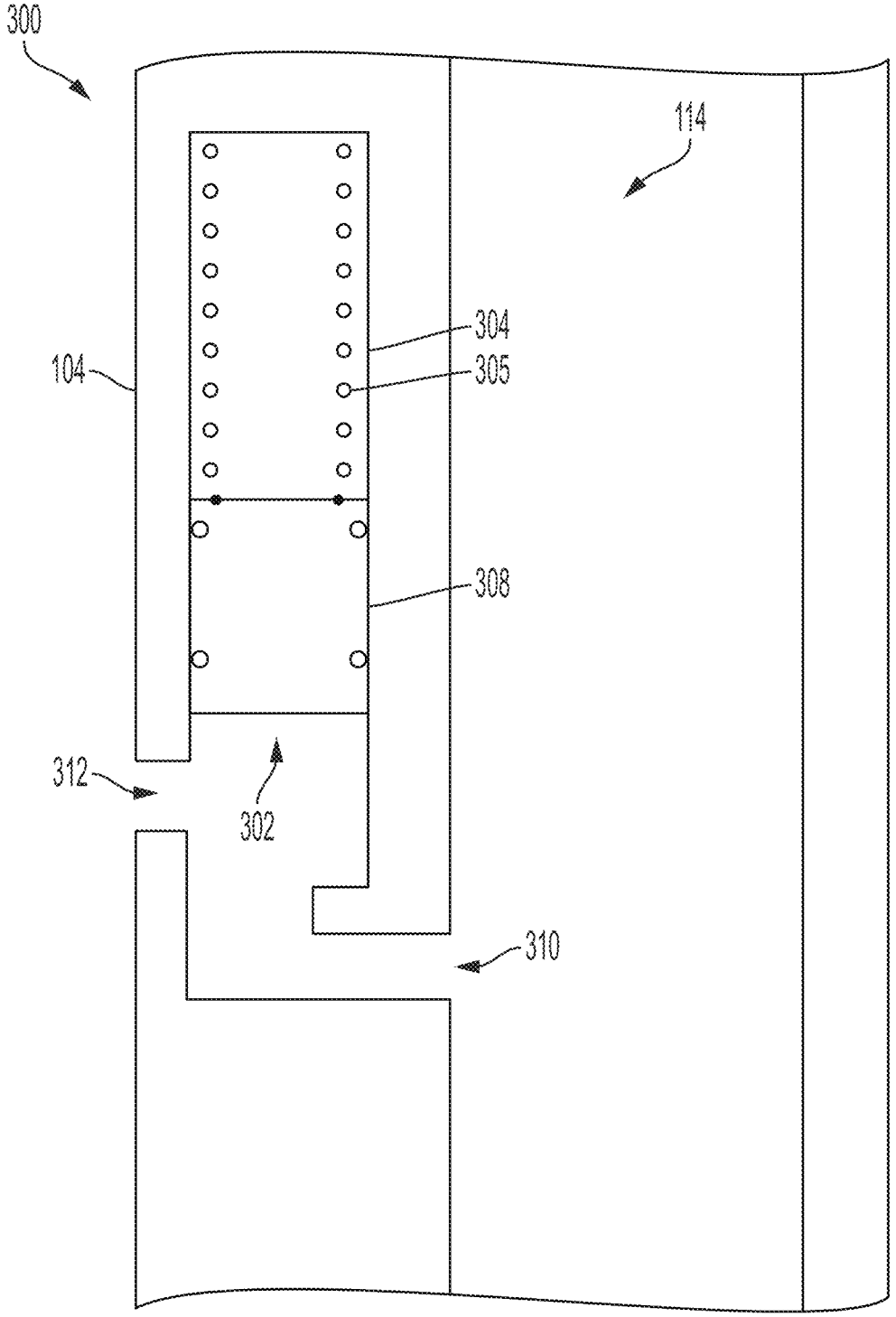
FIG. 3 is a side view of a gas-lift valve with a piston in a section of the wellbore according to some aspects of the present disclosure.

FIG. 3 is an example of a side view of a gas-lift valve 302 with a spring 305 in another section of the wellbore 300 according to some aspects of the present disclosure. The gas-lift valve 302 may include a valve housing 304. In some examples, the valve housing 304 may include a spring 305. The valve housing 304 may include actuation fluid, such as any of the actuation fluids described above in FIG. 2. The gas-lift valve 302 may also include a flow restrictor 308. The flow restrictor 308 may act as a piston as the actuation fluid compresses or expands based on the downhole pressure.

As depicted in FIG. 3, the gas-lift valve 302 may be positioned in-line with the production tubing 104. The production tubing 104 may have a first opening 310 and a second opening 312. Gas from a gas source 110 may flow from the surface of the wellbore 102, into the annulus 114, and into the gas-lift valve 302 through the first opening 310. If the second opening 312 is partially or fully open, the gas may flow through the second opening 312 into the production tubing 104. In other examples, the gas-lift valve 302 may be positioned on the outside of the production tubing 104, rather than in-line. As downhole pressure in the annulus 114 reduces, the actuation fluid in the valve housing 304 may expand. The expanding actuation fluid may cause the flow restrictor 308 to partially or fully block the second opening 312. Similarly, increasing downhole pressure in the annulus 114 may increase the density of the actuation fluid, causing the flow restrictor 308 away from the second opening 312 to partially or fully open the second opening 312.

In some examples, the flow restrictor 308 may be biased with a spring 305. For example, the valve housing 304 may include an actuation fluid of propane along with the spring 305 that may reduce the pressure of the propane by 200 psi. As a result, the propane may condense when the downhole pressure is 390 psi because the propane is experiencing a biasing pressure of 190 psi. This biasing pressure may be useful for adjusting the downhole pressure. In some examples, the spring and the valve housing 304 may be a single component. Alternatively, the spring may be external to the valve housing 304.

Figure 4:
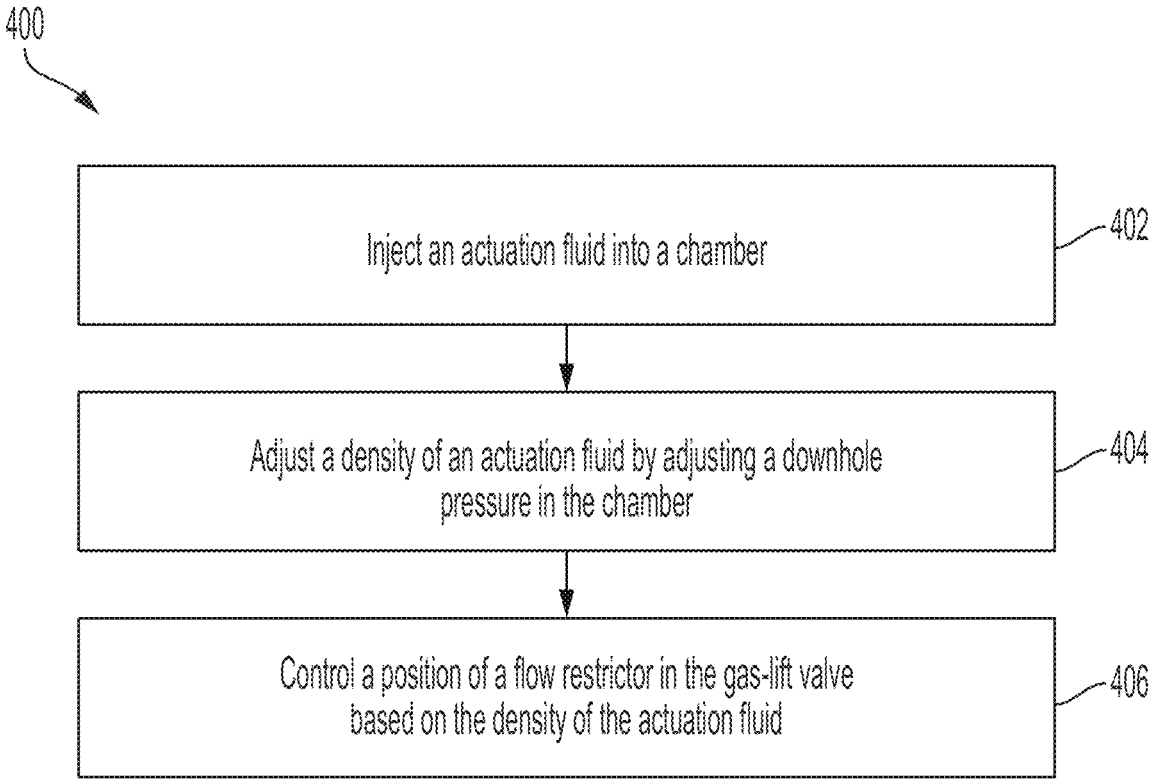
FIG. 4 is a flowchart of a process for adjusting a gas-lift valve to control the flow of gas through production tubing according to some aspects of the present disclosure.

FIG. 4 is an example of a flowchart of a process 400 for adjusting a gas-lift valve 108 to control the flow of gas through production tubing 104 according to some aspects of the present disclosure. The elements and steps of process 400 are described with respect to FIGS. 1-3.

At block 402, actuation fluid is injected into a chamber of a gas-lift valve 108. For example, the chamber may be a valve housing, such as the bellow 202 of FIG. 2, or the valve housing 304 of FIG. 3. The actuation fluid may be injected into the gas-lift valve 108 before the gas-lift valve 108 is positioned downhole along the production tubing 104.

At block 404, the density of the actuation fluid may be adjusted by adjusting a downhole pressure in the chamber. The downhole pressure in the chamber may be adjusted by adjusting a downhole pressure of the annulus 114. For example, the gas source 110 may inject a second fluid, such as a gas, into the annulus 114. The second fluid may have a lower density than a produced wellbore fluid. Injecting more or less gas may increase or decrease the downhole pressure of the annulus 114 and of the chamber of the gas-lift valve 108. Increasing the downhole pressure of the annulus 114 may increase the density of the actuation fluid, and in some examples may cause the actuation fluid to experience a phase change with rapid increase of density.

At block 406, the position of a flow restrictor in the gas-lift valve 108 is controlled based on the density of the actuation fluid. The flow restrictor may be the flow restrictor 206 of FIG. 2, or the flow restrictor 308 of FIG. 3. If the density of the actuation fluid increases, the valve housing may move the flow restrictor away from an opening of the gas-lift valve 108, allowing the gas to pass through the gas-lift valve 108 into production tubing 104. If the density of the actuation fluid decreases, the valve housing may move the flow restrictor closer to the opening of the gas-lift valve 108 to partially or entirely block the opening, thus decreasing or preventing the flow of gas through the gas-lift valve 108. The gas may intersperse with and lower the density of the produced wellbore fluid, causing the produced wellbore fluid to rise in the wellbore 102.

Figure 5:
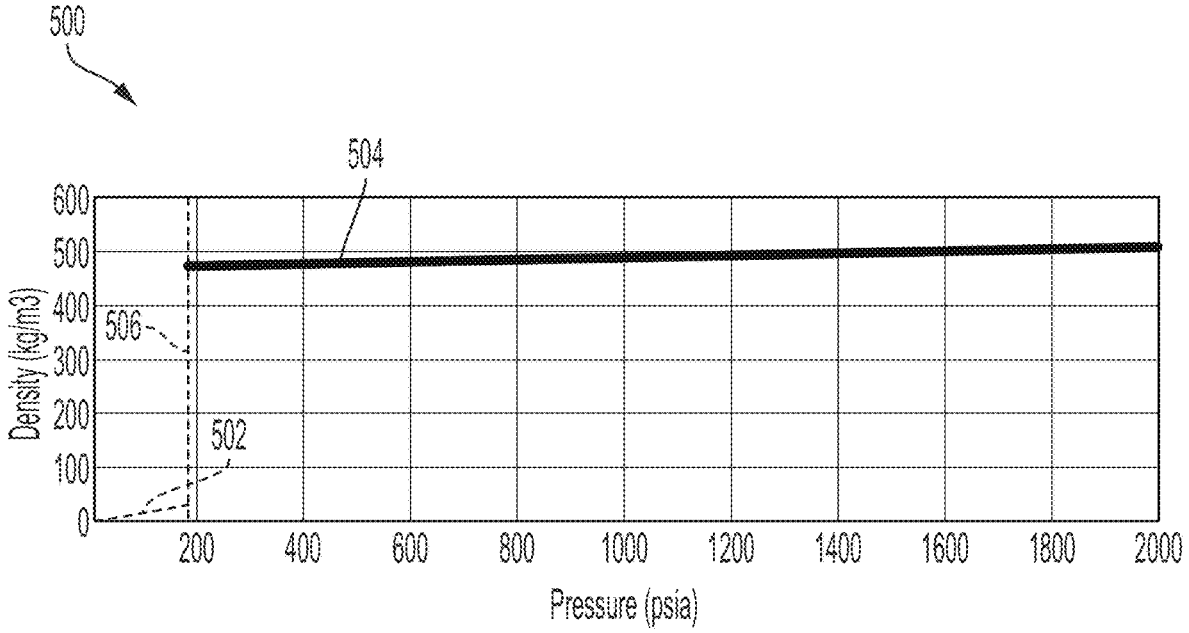
FIG. 5 is a graph of a phase change for propane at a certain temperature according to some aspects of the present disclosure.

FIG. 5 is an example of a graph 500 of a phase change for propane at a certain temperature according to some aspects of the present disclosure. For example, the certain temperature may be 100° F. The x-axis of the graph 500 is pressure, measured in psi, and the y-axis of the graph 500 is density, measured in kg/m$^3$. The dotted line 502 plots the propane in its gas phase, between 0 and 180 psi and at low density. The phase change line 506 denotes the pressure of 180 psi at which propane changes from gas phase to liquid phase. The solid line 504 plots the propane in its liquid phase, between 180 and 2000 psi and at a high density. Propane may be used as an actuation fluid in valve housings of gas-lift valves, such as the gas-lift valve 201 with a bellow 202 of FIG. 2, or the gas-lift valve 302 including a spring 305 of FIG. 3. Because the density of propane changes dramatically between its gas phase and its liquid phase, using propane as an actuation fluid may be useful for gas-lift valves 108 that switch between keeping an opening of the gas-lift valve 108 fully open or fully closed.

Figure 6:
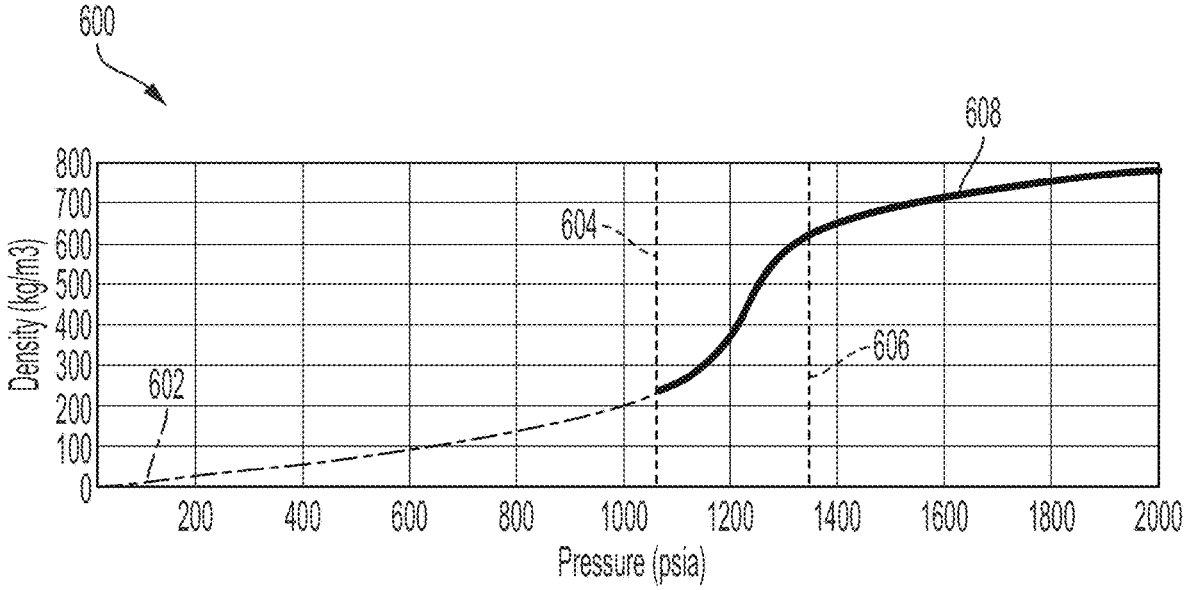
FIG. 6 is a graph of a phase change for carbon dioxide at a certain temperature according to some aspects of the present disclosure.

FIG. 6 is an example of a graph 600 of a phase change for carbon dioxide at a certain temperature according to some aspects of the present disclosure. For example, the certain temperature may be 100° F. The x-axis of the graph 600 is pressure, measured in psi, and the y-axis of the graph 600 is density, measured in kg/m$^3$. The dotted line 602 plots the carbon dioxide in its gas phase, between 0 and 1150 psi and at a low density. The change in state of matter line 604 denotes the pressure of 1150 psi at which the carbon dioxide changes from gas phase to supercritical phase. In supercritical phase, distinct liquid and gas phases may not exist and small changes in pressure or temperature may result in large changes in density, as shown in solid line 608. For example, the density of the carbon dioxide may double between the change in state of matter line 604 pressure and the pressure line 606 of 1350 psi. The doubling in density over a 200 psi range can represent the phase change in the carbon dioxide. Carbon dioxide may be used as an actuation fluid in valve housings of gas-lift valves, such as the gas-lift valve 201 with a bellow 202 of FIG. 2, or the gas-lift valve 302 including a spring 305 of FIG. 3. Using carbon dioxide as an actuation fluid may allow for changes in the size of an opening in the gas-lift valve 108 that are proportional to the changes in the downhole pressure. For example, a carbon dioxide actuation fluid may be useful for controlling a range of sizes for the opening.

In some aspects, an apparatus, method, and system for controlling a gas-lift valve via phase changes are provided according to one or more of the following examples:

Example #1: A gas-lift valve can include a valve housing at least in part defining a chamber for receiving an actuation fluid and a flow restrictor having a position that is controllable by adjusting a downhole pressure in a wellbore to change a density of the actuation fluid in the chamber.

Example #2: The gas-lift valve of Example #1 may feature the position of the flow restrictor being controllable by adjusting the downhole pressure from a surface of the wellbore.

Example #3: The gas-lift valve of any of Examples #1-2 may feature the position of the flow restrictor being controllable to control a flow of a second fluid into the wellbore.

Example #4: The gas-lift valve of any of Examples #1-3 may feature the second fluid having a lower density than a produced wellbore fluid.

Example #5: The gas-lift valve of any of Examples #1-4 may feature the second fluid being injectable from a surface of the wellbore into a production tubing in the wellbore.

Example #6: The gas-lift valve of any of Examples #1-5 may feature the actuation fluid being a propane gas, a carbon dioxide gas, or a combination of fluids.

Example #7: The gas-lift valve of any of Examples #1-6 may feature the gas-lift valve being positionable on a production tubing in an annulus of the wellbore. The gas-lift valve may feature the valve housing being a bellow that is expandable by adjusting the downhole pressure, and the flow restrictor being positionable to restrict an opening in the production tubing based on an expansion of the bellow.

Example #8: The gas-lift valve of any of Examples #1-7 may feature the gas-lift valve being positionable within a production tubing in the wellbore. The valve housing can include a piston that is movable by adjusting the downhole pressure, and the flow restrictor can be positionable to restrict an opening in the production tubing based on a movement of the piston.

Example #9: A method can include injecting an actuation fluid into a chamber, the chamber at least in part being definable by a valve housing in a gas-lift valve in a wellbore. The method can include adjusting a density of the actuation fluid in the chamber by adjusting a downhole pressure. The method can include controlling a position of a flow restrictor in the gas-lift valve based on the density of the actuation fluid.

Example #10: The method of Example #9 may feature controlling the position of the flow restrictor by adjusting the downhole pressure from a surface of the wellbore.

Example #11: The method of any of Examples #9-10 may feature controlling the position of the flow restrictor by controlling a flow of a second fluid into the wellbore.

Example #12: The method of any of Examples #9-11 may feature the second fluid having a lower density than a produced wellbore fluid.

Example #13: The method of any of Examples #9-12 can include injecting, from a surface of the wellbore, the second fluid into a production tubing in the wellbore.

Example #14: The method of any of Examples #9-13 may feature the actuation fluid is a propane gas, a carbon dioxide gas, or a combination of fluids.

Example #15: The method of any of Examples #9-14 may feature the gas-lift valve being positioned on a production tubing in an annulus of the wellbore, the valve housing being a bellow that expands by adjusting the downhole pressure, and the flow restrictor being positioned to restrict an opening in the production tubing based on an expansion of the bellow.

Example #16: The method of any of Examples #9-15 may feature the gas-lift valve being positioned within a production tubing in the wellbore, the valve housing including a piston that moves by adjusting the downhole pressure, and the flow restrictor being positioned to restrict an opening in the production tubing based on a movement of the piston.

Example #17: An apparatus can include production tubing positionable downhole in a wellbore, the production tubing including an opening, and a gas-lift valve couplable to the production tubing. The gas-lift valve can include a valve housing at least in part defining a chamber for receiving an actuation fluid and a flow restrictor having a position that is controllable by adjusting a downhole pressure to change a density of the actuation fluid in the chamber.

Example #18: The apparatus of Example #17 may feature the position of the flow restrictor being controllable by adjusting the downhole pressure from a surface of the wellbore.

Example #19: The apparatus of any of Examples #17-18 can include a plurality of gas-lift valves couplable to the production tubing. The plurality of gas-lift valves may receive a plurality of actuation fluids.

Example #20: The apparatus of any of Examples #17-19 may feature a position of a flow restrictor of each gas-lift valve of the plurality of gas-lift valves being controllable based on a phase change pressure of an actuation fluid of the plurality of actuation fluids received by each gas-lift valve.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A gas-lift valve comprising:

a valve housing at least in part defining a chamber for receiving an actuation fluid; and a flow restrictor having a position that is controllable by adjusting a downhole pressure in a wellbore to cause a phase change of the actuation fluid by changing a density of the actuation fluid in the chamber.

2. The gas-lift valve of claim 1, wherein the position of the flow restrictor is controllable by adjusting the downhole pressure from a surface of the wellbore.

3. The gas-lift valve of claim 1, wherein the position of the flow restrictor is controllable to control a flow of a second fluid into the wellbore.

4. The gas-lift valve of claim 3, wherein the second fluid has a lower density than a produced wellbore fluid.

5. The gas-lift valve of claim 3, wherein the second fluid is injectable from a surface of the wellbore into a production tubing in the wellbore.

6. The gas-lift valve of claim 1, wherein the actuation fluid is a propane gas, a carbon dioxide gas, or a combination of fluids.

7. The gas-lift valve of claim 1, wherein the gas-lift valve is positionable within a production tubing in the wellbore, wherein the valve housing further comprises a piston that is movable by adjusting the downhole pressure, and wherein the flow restrictor is positionable to restrict an opening in the production tubing based on a movement of the piston.

8. A method comprising:

injecting an actuation fluid into a chamber, the chamber at least in part being definable by a valve housing in a gas-lift valve in a wellbore;

adjusting a density of the actuation fluid in the chamber to cause a phase change of the actuation fluid by adjusting a downhole pressure; and controlling a position of a flow restrictor in the gas-lift valve based on the phase change of the actuation fluid.

9. The method of claim 8, wherein controlling the position of the flow restrictor further comprises adjusting the downhole pressure from a surface of the wellbore.

10. The method of claim 8, wherein controlling the position of the flow restrictor further comprises controlling a flow of a second fluid into the wellbore.

11. The method of claim 10, wherein the second fluid has a lower density than a produced wellbore fluid.

12. The method of claim 10, further comprising:

injecting, from a surface of the wellbore, the second fluid into a production tubing in the wellbore.

13. The method of claim 8, wherein the actuation fluid is a propane gas, a carbon dioxide gas, or a combination of fluids.

14. The method of claim 8, wherein the gas-lift valve is positioned within a production tubing in the wellbore, wherein the valve housing includes a piston that moves by adjusting the downhole pressure, and wherein the flow restrictor is positioned to restrict an opening in the production tubing based on a movement of the piston.

15. An apparatus comprising:

production tubing positionable downhole in a wellbore, the production tubing including an opening; and a gas-lift valve couplable to the production tubing, the gas-lift valve comprising:

a valve housing at least in part defining a chamber for receiving an actuation fluid; and a flow restrictor having a position that is controllable by adjusting a downhole pressure to cause a phase change of the actuation fluid by changing a density of the actuation fluid in the chamber.

16. The apparatus of claim 15, wherein the position of the flow restrictor is controllable by adjusting the downhole pressure from a surface of the wellbore.

17. The apparatus of claim 15, further comprising a plurality of gas-lift valves couplable to the production tubing, wherein the plurality of gas-lift valves receive a plurality of actuation fluids.

18. The apparatus of claim 17, wherein a position of a flow restrictor of each gas-lift valve of the plurality of gas-lift valves is controllable based on a phase change pressure of an actuation fluid of the plurality of actuation fluids received by each gas-lift valve.

19. The apparatus of claim 15, wherein the position of the flow restrictor is controllable to control a flow of a second fluid into the wellbore.

20. The apparatus of claim 19, wherein the second fluid has a lower density than a produced wellbore fluid.

* * * * *